US007348520B2

(12) United States Patent
Wang

(10) Patent No.: US 7,348,520 B2
(45) Date of Patent: Mar. 25, 2008

(54) OVEN WITH A HEAT CIRCULATING DEVICE

(76) Inventor: Ching-Hsiang Wang, P.O. Box 90, Tainan City 70499 (TW)

( * ) Notice: Subject to any disclaimer, the term of this patent is extended or adjusted under 35 U.S.C. 154(b) by 152 days.

(21) Appl. No.: 11/378,341

(22) Filed: Mar. 20, 2006

(65) Prior Publication Data

US 2007/0215592 A1 Sep. 20, 2007

(51) Int. Cl.
*A21B 1/24* (2006.01)
*A21B 1/26* (2006.01)

(52) U.S. Cl. ..... 219/400; 219/401; 126/20; 126/21 A; 99/467; 99/468; 99/476

(58) Field of Classification Search ..... None
See application file for complete search history.

(56) References Cited

U.S. PATENT DOCUMENTS

| | | | | |
|---|---|---|---|---|
| 6,772,751 | B2 * | 8/2004 | Deuringer et al. | 126/20 |
| 6,987,246 | B2 * | 1/2006 | Hansen et al. | 219/401 |
| 2004/0261632 | A1 * | 12/2004 | Hansen et al. | 99/468 |
| 2007/0114222 | A1 * | 5/2007 | Shon et al. | 219/401 |

* cited by examiner

*Primary Examiner*—J. Pelham

(57) ABSTRACT

An oven with a heat-circulating device includes a housing provided with a chamber for roasting and steaming; a motor fixed on a rear surface of a rear wall of the chamber; a fan; a heater; a separating plate positioned in front of the fan; a steaming device; a tray and a cover. The e annular heater and the fan fixed on an inner surface of the rear wall in front of the motor. The steaming device is composed of a connect tube, a pump motor, an outflow tube and a heating case for heating the water filled in the heating case for producing steam to be blown and circulated by the fan also blowing the hot air to circulate in a balanced condition around the chamber and a food placed to be roasted and steamed synchronously, with the food not losing all water contained.

4 Claims, 4 Drawing Sheets

OVEN WITH A HEAT CIRCULATING DEVICE

BACKGROUND OF THE INVENTION

1. Field of the Invention

This invention relates to an oven with a heat circulating device, particularly to one provided with a motor for driving a fan to blow air wind to circulate heat generated by an electric heater through a wind hole of a separating plate and also circulating steam produced by a steaming device in the interior of a chamber formed in a housing of the oven, so that food placed in the chamber for roasting may be roasted and steamed at the same time with the water in the roasted and steamed food still keeping some water to be eaten with delicious taste.

2. Description of the Prior Art

A conventional oven 1 shown in FIG. 1 includes a heater 11 in the bottom or in the interior of a housing, a roast frame 10 for supporting a food thereon, with a heater turned on for roasting the food. However, the roast frame 10 is stationary, and the heat in the oven may be not circulate in a balanced condition, with the front portion of the interior being not as hot as the rear portion of the interior chamber to cause uneven roasting to the food, which must then be turned over several times, giving rise to troublesome process for roasting job. Further, food roasted in the conventional oven may lose almost all water contained in the food after finished in roasting, becoming comparatively hard and dry, quite not tasty.

SUMMARY OF THE INVENTION

The purpose of the invention is to offer an oven with a heat circulating device, which is provided with a motor for driving a fan to blow heat generated by a heater, and a steaming device for generating steam to be blown by the same fan to circulate in the oven and also around a food placed in the oven to be roasted and steamed synchronously so that the finished food may still keep substantial water to be tasty for eating.

The feature of the oven with a heating circulating device is a motor, a fan and a heater for generating hot air wind to circulate in the chamber in the housing of the oven, and a steaming device for generating steam from the water in a center hollow of a heating case supplied by a water tank kept in a tray fitted in a tray recess of the housing and blown by the fan with the air wind so as to roast and steam the food synchronously, letting the roasted and steamed food still keep some water to be eaten with delicious taste.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
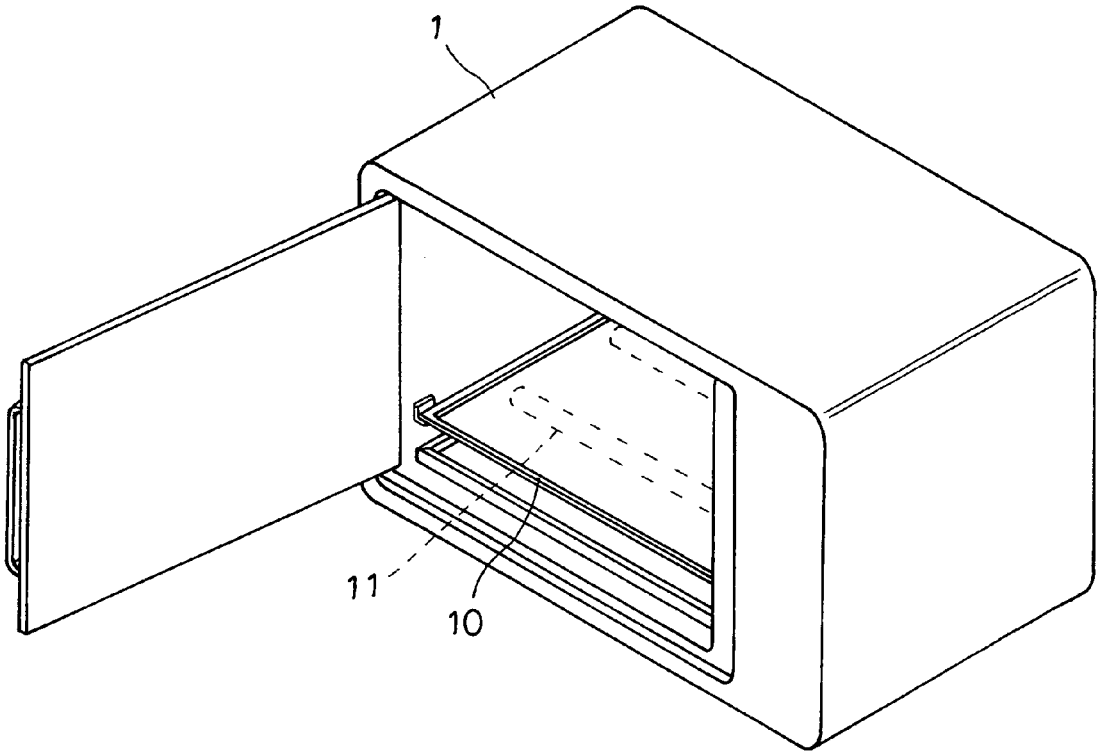
FIG.1 (PRIOR ART)
FIG. 1 is a perspective view of a conventional electric oven.
Figure 2:
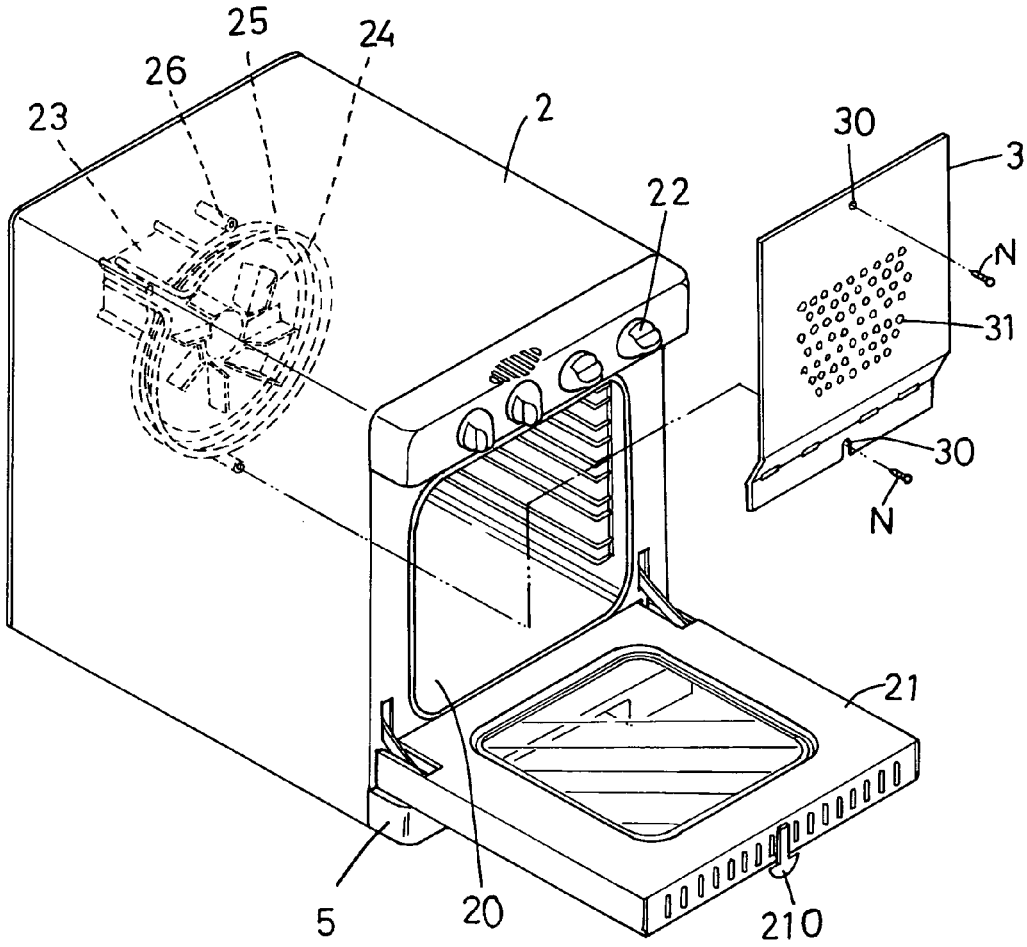
FIG. 2 is a perspective view of an oven with a heat circulating device in the present invention.
Figure 3:
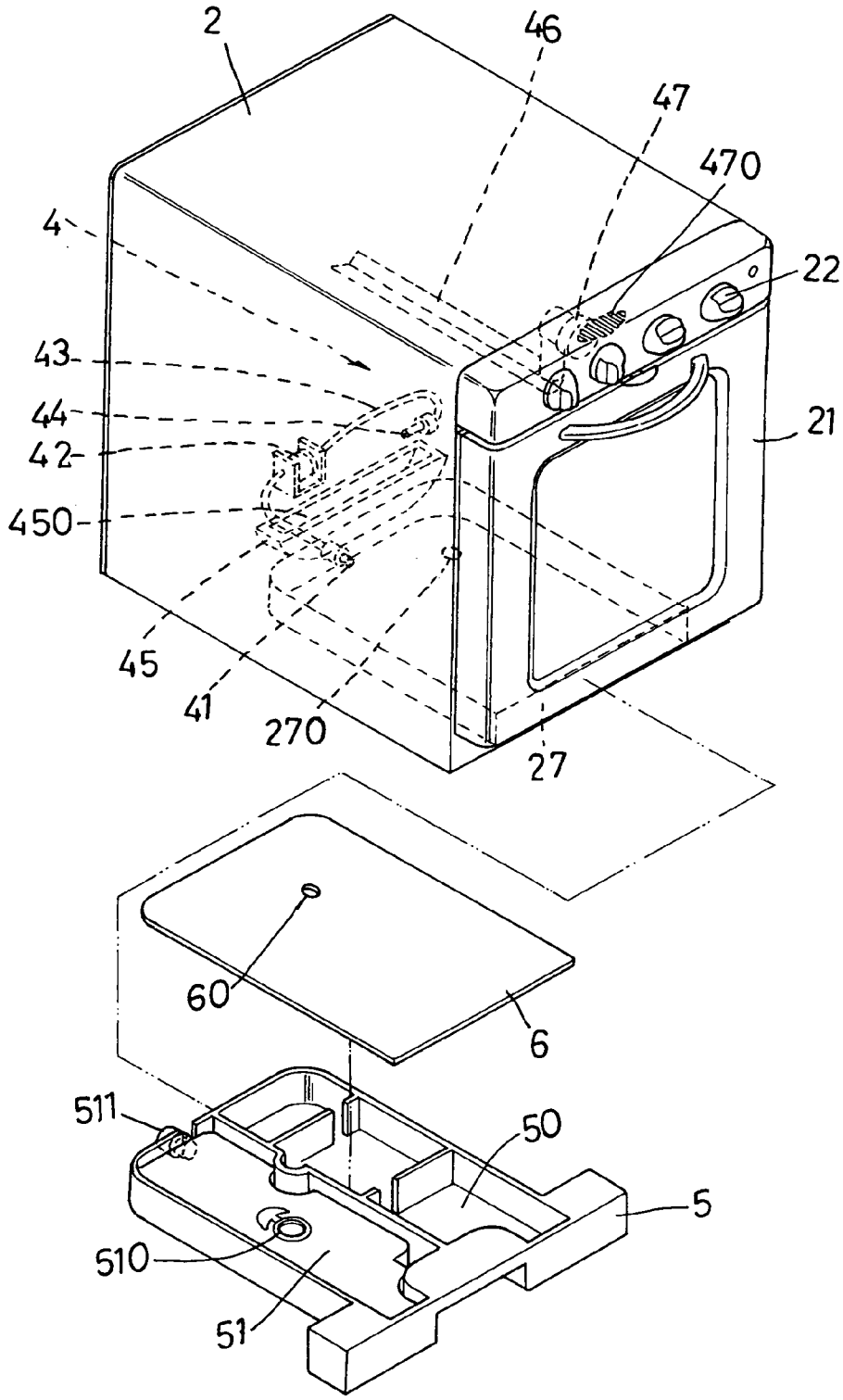
FIG. 3 is an exploded perspective view of a steaming device and a tray in the present invention; and, FIG. 4 is a cross-sectional view of the oven with a heat-circulating device in the present invention.
Figure 4:
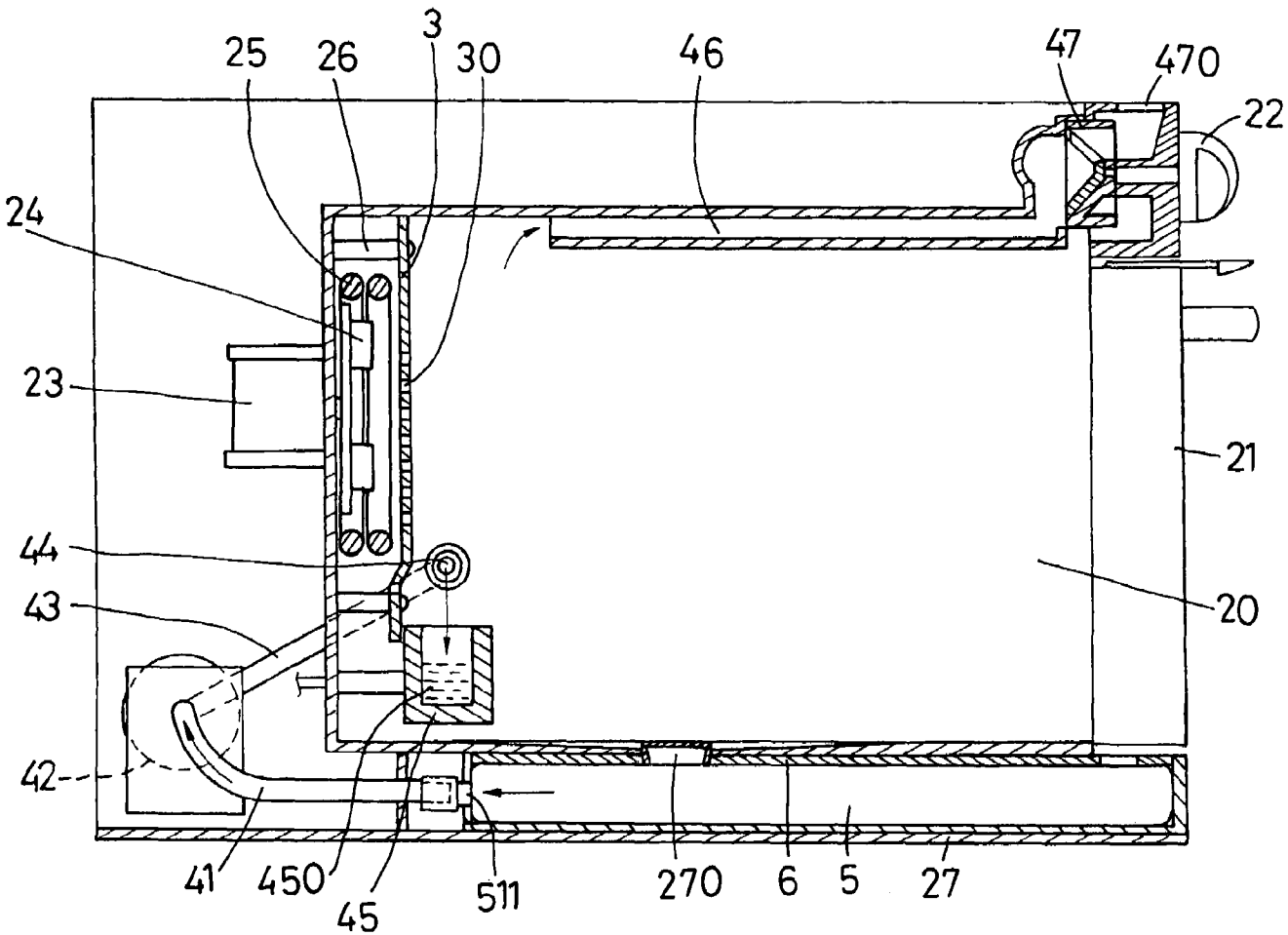

A preferred embodiment of an oven with a heat-circulating device in the present invention, as shown in FIGS. 2, 3 and 4, includes a housing 2, a motor 23, a fan 24, a heater 25, a separating plate 3, a steaming device 4, a tray 5, a water tank 51 and a cover 6 as main components.

The housing 2 is provided with a chamber 20 defined by an upper wall, a rear wall and a bottom wall in its interior, a door 21 combined with a front side, a grip 210 fixed on the door 21, and plural buttons 22 fixed on a front side of an upper wall on the door 21.

The fan 24 and the heater 25 are fixed on an inner surface of the rear wall of the chamber 20, with the motor 23 fixed on an outer surface of the rear wall, and with the fan 24 located just in front of the motor 23. The heater 25 is annular, surrounding the fan 24, so the heat generated by the heater 25 can be blown by the fan 24 to circulate in the chamber in a balanced condition.

The buttons 22 are electrically connected with the motor 23, the fan 24 and the heater 25 for turning on and off those components and adjusting the current to the heater 25. Further, the housing 2 is also provided with a tray recess 27 formed in a bottom under the bottom wall of the chamber 20, and the tray recess 27 has a water hole 270 communicating with the chamber 20

The separating plate 3 is positioned vertically in the chamber 20, fixed with a screw (N) engaging with a threaded post 26 horizontally fixed on the rear wall of the chamber 20, provided with a threaded hole 30 aligned to the threaded post 26, and a center hole 31 facing the fan 24.

The steaming device 4 is deposited in the chamber 20, composed of a connect tube 41, a pump motor 42, an outflow tube 43, a heating case 45, an exhaust passageway 46 and an adjuster 47. The connect tube 41 has one end extending through a rear wall of the tray recess 27 and the other end connected with the pump motor 42 connected with the outflow tube 43, which has its end formed with an outlet 44 located in the chamber 20. The heating case 45 is located below the outlet 44, having a center hollow 450 for keep water to be heated, and the exhaust passageway 46 is fixed in an upper portion of the chamber 20 along the upper wall, having one end connected with the adjuster 47, which can be handled to adjust the volume of air and steam to be exhausted, having an outlet hole 470 at its outer end.

The tray 5 is placed in the tray recess 27 of the housing 2, provided with a water chamber 50, and a water tank 51 formed in a nearly half portion of the tray 5 beside the water chamber 50 and provided with a pouring hole 510, with a short outlet pipe 511 fixed at an inner side and connected with the connect tube 41 of the steaming device 4.

The cover 6 is closed on the tray 5, having a hole 60 aligned to both the water hole 270 of the tray recess and the water chamber 50 of the tray 5, and screwed with the tray 5 with a screw.

In using, referring to FIG. 4, water is firstly poured in the water tank 51 through the pouring hole 510, and then the cover 6 is closed and screwed on the tray 5. Then the tray 5 and the cover 6 together is placed in the tray recess 27 of the housing 2, with the outflow tube 511 of the water tank 51 connected with the connect tube 41 of the steaming device 4, and with the hole 60 of the cover 6 aligned to the water hole 270 of the bottom of the chamber 20. Now a food to be roasted is to be placed in the chamber 20, and the door 21 is to be closed up. Then a user handles the buttons 20 for starting the motor 23 and the heater 25, with the needed temperature adjusted, Then the pump motor 42 is started to pump the water in the water tank 51 into the center hollow 450 of the heating case 45 via the outflow tube 43, and the heating case 45 is turned on to heat the water in the center hollow 450 to convert into steam so that the steam coming out of the center hollow 450 is blown by the fan 24 driven by the motor 23, circulating in a balanced condition around in the chamber 20 and also around the food placed therein for steaming and roasting the food at the same time. So the food can be tasty, without losing completely its water contained.

Next, if the inner pressure of the chamber 20 is to be adjusted lower, the adjuster 47 is handled properly to let the steam in the chamber 20 leak out through the outlet hole 470 via the exhaust passageway 46. Further, partial steam in the chamber 20 may be cooled to become water drops to fall down through the water hole 270 and the hole 60 of the cover 6 and finally into the water chamber 50 of the tray 5. In case that the water gathered in the water chamber 50 is needed to be removed, then the tray 5 with the cover 6 is drawn out of the housing 2 for the purpose, very simple.

While the preferred embodiment of the invention has been described above, it will be recognized and understood that various modifications may be made therein and the appended claims are intended to cover all such modifications that may fall within the spirit and scope of the invention.

What is claimed is:

1. An oven with a heat circulating device comprising:

a housing provided in its interior with a chamber defined by an upper wall, a rear wall and a bottom wall, and a door movably combined with a front side, a grip fixed on said door, and a plurality of buttons arranged on a front side of an upper wall of said housing on said door, a tray recess formed in its bottom under said bottom wall of said chamber and bored with a water hole communicating with said chamber;

a motor fixed on an outer surface of a rear wall of said chamber;

a fan fixed on an inner surface of said rear wall of said chamber in front of said motor and connected and driven by said motor;

an annular heater fixed around said fan to be turned on for generating heat to heat up the air in said chamber;

a steaming device positioned in said chamber, and composed of a connect tube, a pump motor, an outflow tube, a heating case, an exhaust passageway and an adjuster; said connect tube having one end extending through a rear wall of said tray recess and the other end connected with said pump motor also connected with said outflow tube, said outflow tube having an outlet formed at the other end extending in said chamber, said heating case positioned in said chamber below said outlet of said outflow tube, said exhaust passageway positioned in an upper portion of said chamber and having its outer end connected with said adjuster, said adjuster having an outlet hole exposed out of said outer surface of said upper wall of said housing;

a tray placed in said tray recess of said housing, a water tank formed in a nearly half portion of said tray and having a pouring hole in an upper surface, an outlet tube fixed at one side of said water tank and connected with said connect tube of said steaming device; and, said motor and said heater turned on to let said motor drive said fan in case of roasting a food in said chamber, said heater generating heat to heat up the air in said chamber and to be blown by said fan to become hot wind to circulate in a balanced condition around said chamber and around the food therein, said steaming device started to generate steam by said heating case wherein water is stored in said center hollow and heated by said heating case, the steam generated being blown by said fan to circulate in said chamber synchronously with said hot wind to circulate around the food to make the food roasted and steamed at the same time so that the food may not lose its water contained completely.

2. The oven with a heat circulating device as claimed in claim 1, wherein said rear wall of said chamber is provided with a horizontal threaded post, and a separating plate is vertically positioned near said heater and said fan, screwed with said horizontal threaded post with a screw engaging with a threaded hole of said post, and having a wind hole facing to said fan.

3. The oven with a heat circulating device as claimed in claim 1, wherein said tray is provided with a water chamber with an upper opening beside said water tank.

4. The oven with a heat circulating device as claimed in claim 1, wherein a cover is further provided to close on said tray, bored with a water hole aligned to said water hole of said bottom of said chamber and also to said water chamber of said tray.

* * * * *